United States Patent [19]

Sato et al.

[11] 4,440,592

[45] Apr. 3, 1984

[54] PORTABLE TYPE LABEL APPLYING APPARATUS

[75] Inventors: Yo Sato, Tokyo; Tadao Kashiwaba, Kitagami, both of Japan

[73] Assignee: Kabushiki Kaisha Sato, Japan

[21] Appl. No.: 368,732

[22] Filed: Apr. 15, 1982

[30] Foreign Application Priority Data

Apr. 30, 1981 [JP] Japan ..... 56-66223

[51] Int. Cl.[3] ..... B65C 9/18; B65C 9/46; B65C 11/00

[52] U.S. Cl. ..... 156/384; 101/288; 156/577; 156/579; 156/584; 156/DIG. 33; 156/DIG. 47; 156/DIG. 48

[58] Field of Search ..... 156/277, 384, 344, 577, 156/579, 584, DIG. 33, DIG. 47, DIG. 48; 101/288; 242/18 EW, 18 PW, 107, 117, 68.3, 68.5

[56] References Cited

U.S. PATENT DOCUMENTS

| | | | |
|---|---|---|---|
| 3,024,155 | 3/1962 | Huber | 156/584 |
| 3,132,822 | 5/1964 | Arthur | 242/68.5 |
| 3,668,047 | 6/1972 | Heller | 156/584 |
| 3,711,353 | 1/1973 | Zimmer | 156/277 |
| 3,801,408 | 4/1974 | Kuring et al. | 156/584 |
| 3,890,191 | 6/1975 | Mayer | 156/577 |
| 3,944,455 | 3/1976 | French | 156/584 |
| 4,359,939 | 11/1982 | Sato | 101/288 |

FOREIGN PATENT DOCUMENTS

| | | |
|---|---|---|
| 58-11639 | 1/1983 | Japan . |
| 58-20632 | 2/1983 | Japan . |
| 58-20633 | 2/1983 | Japan . |
| 58-24489 | 2/1983 | Japan . |

*Primary Examiner*—Michael G. Wityshyn

*Attorney, Agent, or Firm*—Ostrolenk, Faber, Gerb & Soffen

[57] ABSTRACT

Herein disclosed is a portable type label applying apparatus for delaminating printed labels, which are temporarily adhered in series to a web of backing paper and for applying them to articles. The label applying apparatus comprises a label rolling cassette removably attached to a printer which is adapted to print the unprinted labels of the composite label web. The label rolling cassette includes a label rolling core for rolling up thereon the composite label web printed, a label delaminating turning pin for turning back only the backing paper web to delaminate the labels therefrom, and a guide groove for guiding the turned back backing paper web. There is a label applier to which the label rolling cassette is removably attached. The label applier includes a feed roller that is manually operated for feeding the turned back backing paper web to delaminate the labels, and includes a label applying element for applying the delaminated labels to the articles. A printer prints the labels and sends them to the label rolling core which is on the removably attachable cassette.

43 Claims, 10 Drawing Figures

PORTABLE TYPE LABEL APPLYING APPARATUS

BACKGROUND OF THE INVENTION

1. Field of the Invention

The present invention relates to a portable type label applying apparatus for delaminating printed labels, which are temporarily adhered in series to a web of backing paper, and for applying the labels to articles.

2. Description of the Prior Art

For applying labels of the above-specified type in a supermarket, or the like, a portable type label printing and applying machine which is usually called a hand labeler is used. The hand labeler is comprised of: a holding unit for holding a rolled up composite label web, which web is comprised of unprinted labels temporarily adhered in series to their backing paper web; a printing unit for printing the labels; a feed unit for feeding the label web; and a delaminating unit for delaminating the printed labels from the backing paper of that composite label web to feed the labels out of the hand labeler. Thus, the printing, feeding and delaminating operations are manually performed, and the delaminated labels are applied by adhering them to articles.

This hand labeler is used for applying the printed labels to goods, mainly at a sales counter at which the goods are displayed. Printing and applying of the bar codes for POS systems have spread in recent years. However, some problems arise.

1. Since the printed bar codes are read out by means of an optical reader, strict accuracy is required for the widths and spacings of those bar codes. However, the type of simplified printing head that is mounted in a hand labeler might fail to accurately print bar codes due to constructional errors or due to excessive or insufficient ink being appled to the surfaces of the types by means of an ink roller. As a result, printed bar codes on labels are frequently incorrectly read out by optical readers.

2. A printing head for printing bar codes is necessarily larger than a printing head for printing human readable characters, due to the size relationship of the standardized bar codes. As a result, the size and weight of bar code printing hand labelers are so enlarged as to make the hand labeler difficult to handle and as to increase the fatigue of the operator.

3. Check digits are required for the bar codes. It is, however, difficult for a hand labeler to have the function of automatically calculating check digits because of the restrictions on its size and construction. Therefore, the check digits must be separately calculated, one by one, and then be set in the printing head.

In view of the aforementioned problems with bar code printing hand labelers, there is the practice in which after the composite label web is printed by means of a desk type printer, the printed labels are manually peeled one by one from the backing paper of the composite label web and are applied to goods. However, this manual method remarkably reduces the label applying speed and this deteriorates the working efficiency. Further, the prints on the label surfaces are rubbed during the label applications by the finger tips, so that they become obscure. Therefore, an apparatus which can accurately and efficiently print and apply bar code labels is desired.

SUMMARY OF THE INVENTION

It is an object of the present invention to provide a portable type label applying apparatus which is able to apply labels that have been accurately printed with indicia, including check digits by a desk type printer. The applying apparatus should have excellent operability at a high applying speed without fatiguing the operator and while the printed surfaces of the labels are protected against being blurred.

A portable type label applying apparatus according to the invention is now described. A label rolling cassette is removably attached to a printer. The printer is adapted to print a composite label web having a plurality of labels that are temporarily adhered in a series to a web of backing paper. The label rolling cassette includes label rolling means for rolling up thereon the printed composite label web, delaminating means for turning back only the backing paper web to delaminate the labels therefrom as the web is fed from the label rolling means, and guide means for guiding the turned back backing paper web. The label rolling cassette is removably attached to a label applier. The label applier includes feed means that are manually operated for feeding the backing paper web that has been turned back to delaminate the labels, and label applying means for applying delaminated labels to goods.

Other objects and features of the invention will become apparent from the following description of a preferred embodiment of the invention in conjunction with the accompanying drawings.

DESCRIPTION OF THE PREFERRED EMBODIMENT

Figure 1:
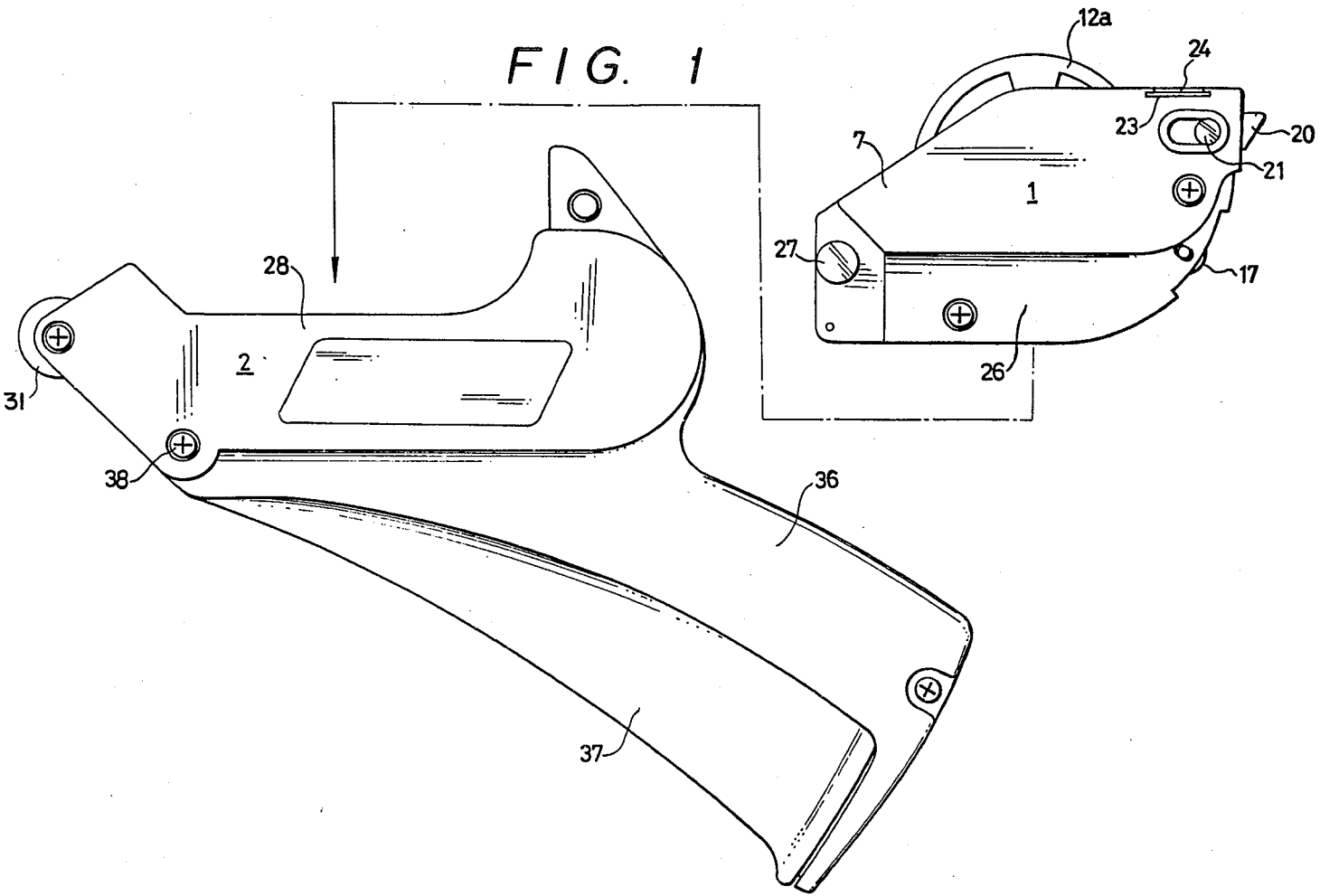
FIGS. 1 and 2 are side and sectional views respectively showing a label rolling cassette and a label applier.

The present invention will now be described in connection with one embodiment with reference to the accompanying drawings.

The label applying apparatus according to the present invention is comprised of: a label rolling cassette 1 for rolling up a composite label web 5 which has been printed with indicia, such as bar codes, by the action of a printer 3; and a label applier 2, to which that label rolling cassette 1 is removably attached and which can be manually operated to feed the composite label web 4 and to delaminate labels 6 one by one from a web of their backing paper 5, thereby to bring those labels 6 into an applicable state.

Figure 3B:
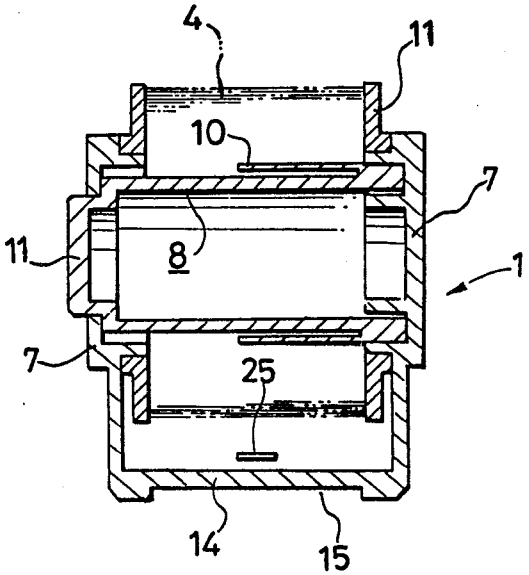
FIGS. 3(A) and 3(B) are a top plan view showing the label rolling cassette and a section taken along line III—III of FIG. 3(A), respectively.
Figure 3A:
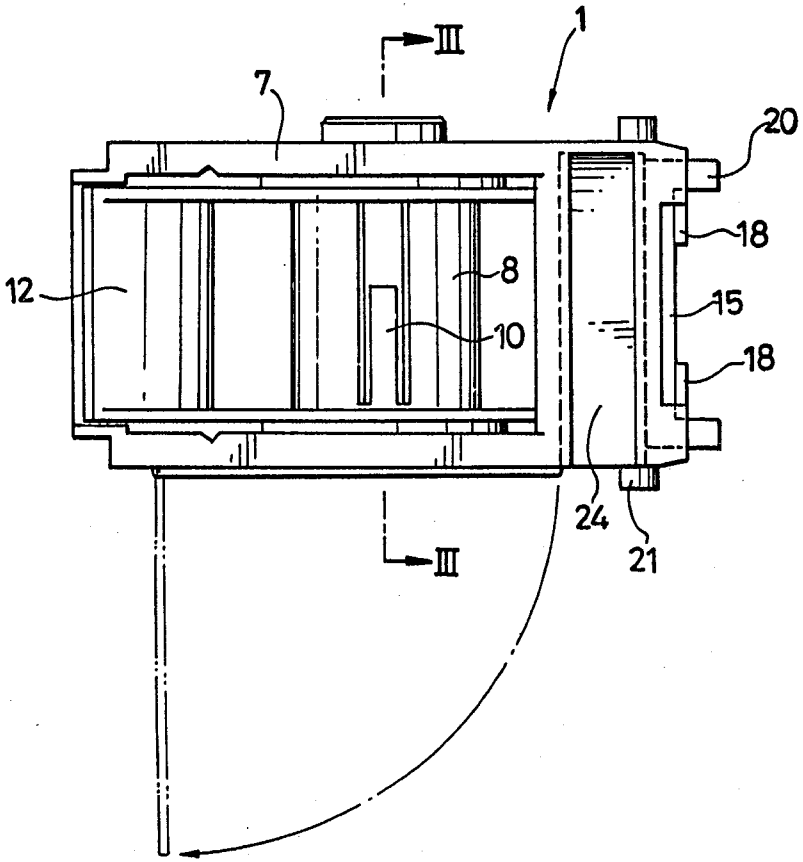

In the center portion of the frame 7 of the label rolling cassette 1, a rolling core 8 having a cylindrical shape is rotatably fitted. At each of four equi-distantly spaced portions of the outer circumference of the rolling core 8, there are a recess 9 and a clamping spring 10 which clamp the leading end of the composite label web 4 when the web is being rolled. One side end portion of the core 8 is closed, as shown in FIG. 3(B), to form a radially reduced abutting portion 11 which protrudes through the frame 7 to the outside.

A rotary bail 12 is hinged to a pair of annular lands 58 which are formed on the facing inner walls of the frame 7 outside of the rolling core 8. The rotary bail 12 is formed at the rear portions of both its side walls with a pair of sideways label web looseness preventing plates 12*a*, which are provided to prevent the composite label web 4 rolled on the core 8 from being loosened sideways. The front end of the bail 12 has a semi-circular label holding portion 13 which merges into both side plates thereof.

Figure 2:
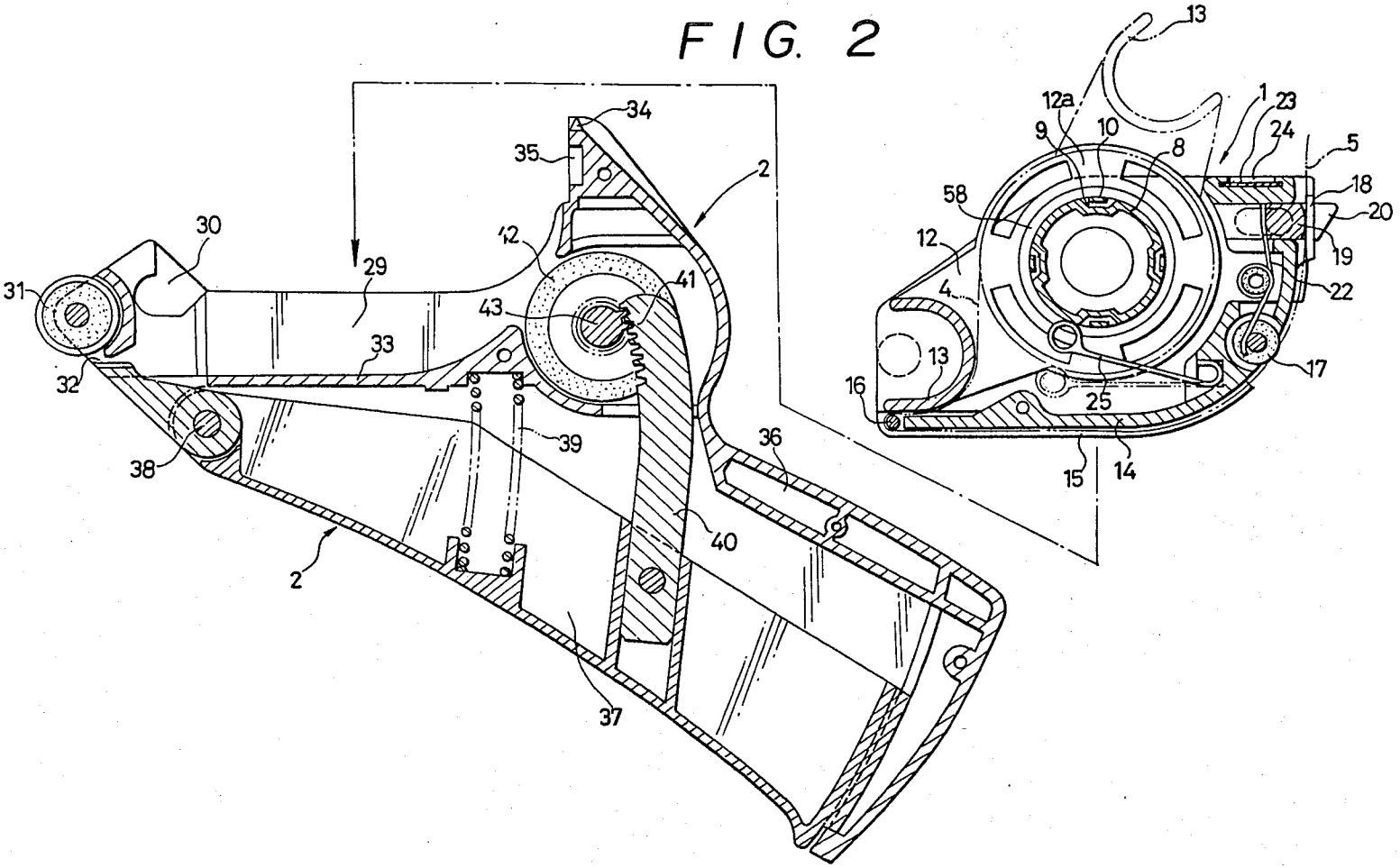

The label rolling cassette 1 is gently curved up from its bottom side at the left or front in FIG. 2 to its right or rear end to form a curved guide plate 14 with a lower side that is formed with a backing paper guide groove 15 extending from the front end to the rear end.

The guide plate 14 has a turning pin 16 at its front end for turning the backing paper web 5 from the composite label web 4. Midway along the guide plate 14, a sub-roller 17 is rotatably attached. Its outer circumference protrudes slightly for feeding the backing paper web 5 in cooperation with the feed roller 42 of the label applier 2, as described below.

A pair of backing paper holding plates 18 protrude from the frame 7 into the backing paper guide groove 15. A hook member 19 is slidably received in the rear end of the frame 7. The hook member 19 is formed with a pair of right and left protruding hooks 20 at its rear portion and with a pair of knobs 21 at both of its right and left ends. The hook member 19 is continuously biased rearwardly by a torsion spring 22 so that the hooks 20 usually protrude from the rear side of the frame 7.

The frame 7 is formed in the upper side of its rear portion with a recess 24 for receiving an indication plate 23. An elastic member 25 is disposed below the rolling core 8 for preventing the rolled up composite label web 4 from becoming slack. The label rolling cassette 1 is slightly recessed at the outer sides of its lower portion between the sides of the frame 7 to form an attachment portion 26, at which the cassette is attached to the printer 3 or the label applier 2. The frame is formed with round engaging lands 27 at both sides of the front end of the attachment portion 26.

The label applier 2 includes a frame 28 which is recessed at its upper portion to form a receptacle 29 in which the attachment portion 26 of the label rolling cassette 1 is to be placed and received. The front end of the receptacle 29 is formed in both its sides with recesses 30 which engage with the engaging lands 27 of the label rolling cassette 1. A label applying roller 31 is rotatably pivoted to the front end of the frame 28. Below the roller 31, a label exit 32 is opened.

The bottom of the receptacle 29 is defined by a curved guide plate 33 which corresponds in shape to the guide plate 14 of the label rolling cassette 1. That guide plate 33 has a rear portion which at its upper end carries a backing paper cutter 34. Below the backing paper cutter 34, the guide plate includes a pair of hook holes 35 for receiving the hooks 20 of the label rolling cassette 1.

The lower portion of the frame 28 extends obliquely backward to provide a grip 36. Below the grip 36, a hand lever 37 is swingably disposed. The leading end of the hand lever is attached to the frame 28 by a pivot pin 38. A return spring 39 is disposed in the hand lever 37. The upper end of the spring 39 abuts against a portion of the frame 28 so that the hand lever 37 is always biased clockwise (i.e. downward). An actuating lever 40 has a lower end that is fixed to the hand lever 37 and has an upper end formed with a rack 41. The rack 41 is positioned and sized to mesh with the pinion 43 of the feed roller 42 which is fitted in the frame 28. The feed roller 42 is equipped with a built-in one-way clutch mechanism (not shown), so that it is adapted to rotate only in the clockwise direction in FIG. 2. As a result, only the pinion 43 is rotated when the hand lever 37 is squeezed to lift the actuating lever 40. When the hand lever 37 is released, on the contrary, the feed roller 42 is rotated clockwise together with the pinion 43.

The outer circumferential portion of the feed roller 42 is made of an elastic material, such as rubber, and the portion then at the guide plate 33 is exposed to the outside at the opening formed in the plate 33. The feed roller engages the backing paper web and pulls it to the rear.

Figure 4:
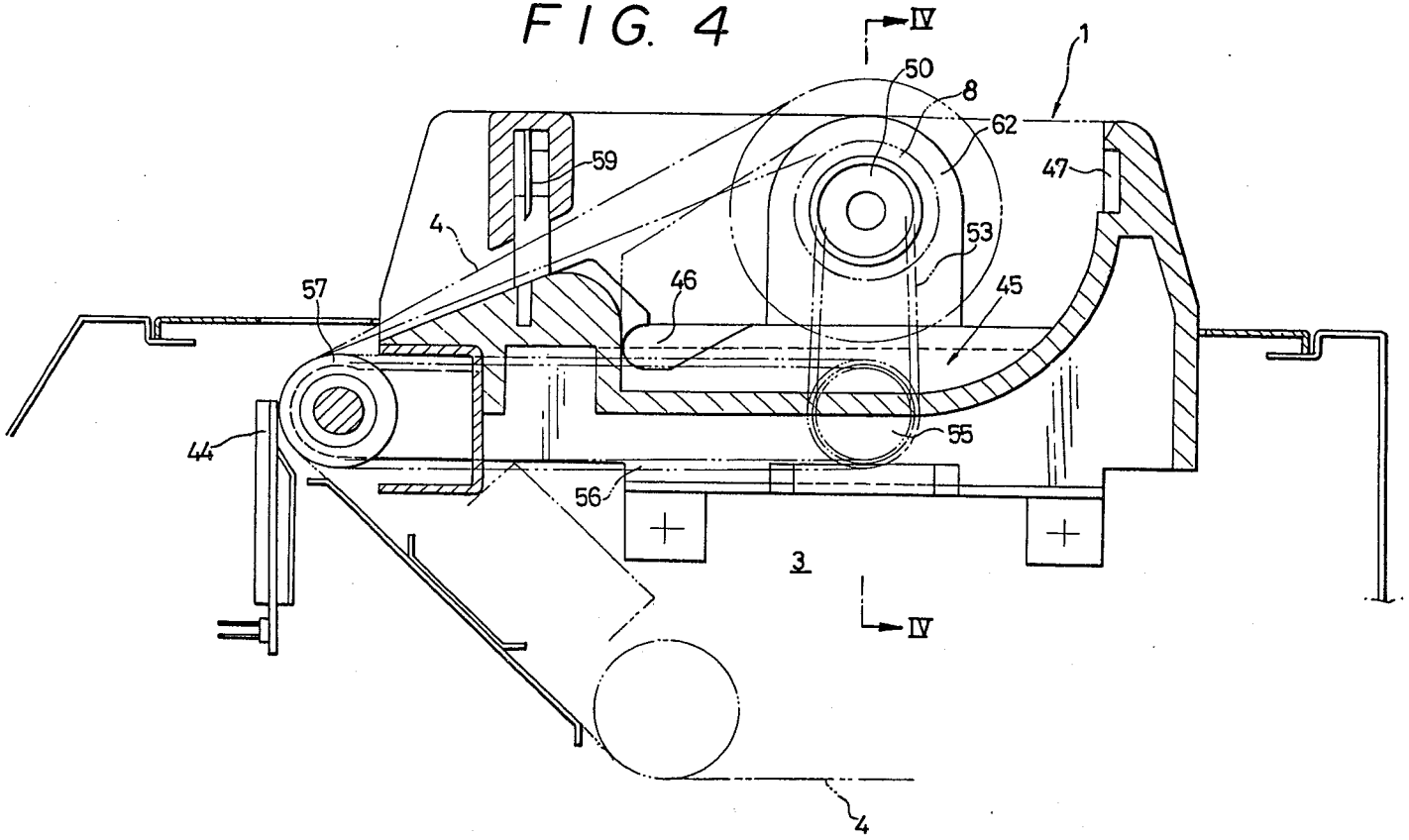
FIG. 4 is a sectional view essentially showing a printer.

Next, one example of a printer 3 which is suitable for the present invention is described with reference to FIGS. 4 and 5. The printer 3 is a thermal printer which prints the labels 6 of the composite label 4 by a thermal head 44. The composite label web 4 thus printed is rolled up upon the label rolling cassette 1 which is removably set in the receptacle 45 of the printer 3.

The receptacle 45 is constructed similarly to the receptacle 29 of the label applier 2 in that both sides of its front end are formed with recesses 46 and the upper portion of its rear end is formed with a pair of hook holes 47.

Figure 5:
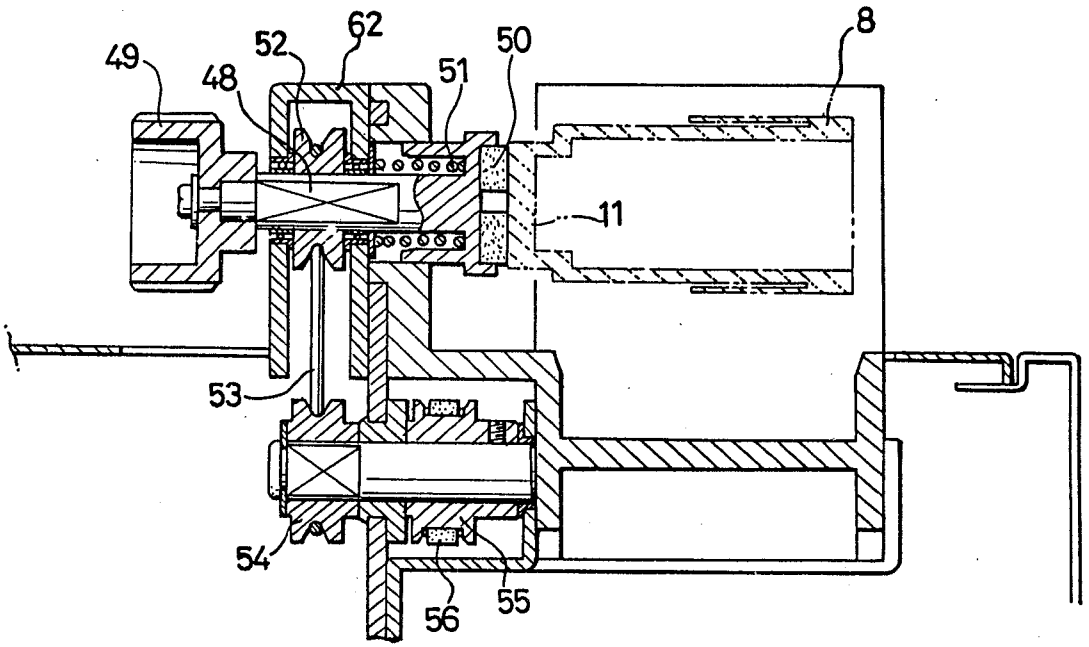
FIG. 5 is a section taken along line IV—IV of FIG. 4.

At one lateral side of the receptacle 45, there is a supporting post 62, through which a transmission shaft 48 extends (FIG. 5). One end of the transmission shaft 48 is equipped with a knob 49 and its other end is equipped with a slip permitting rubber element 50. The transmission shaft 48 is always biased (to the right in FIG. 5) away from the knob 49 by the coil spring 51. A pulley 52 (FIG. 5) is mounted on the transmission shaft 48. The pulley 52 is rotatable through a belt 53, pulleys 54 and 55 and a belt 56 in synchronism with a platen roll 57 (FIG. 5). There is a cutter 59, which is to be depressed after the printing operation by means of a knob, or the like (not shown), to cut the composite label web 4.

The operation of the foregoing embodiment is now described.

First, the label rolling cassette 1 is set in the printer 3. The attachment portion 26 is placed and received in the receptacle 45, while the round engaging lands 27 at the front end of the cassette 1 are engaged with the recesses 46 of the receptacle 45, and the hooks 20 at the rear end of the cassette are brought into engagement with the hook holes 47. By this setting operation, the round laterally projecting abutting portion 11 of the rolling core 8 is brought into aligned abutment against the slip rubber element 50 (FIG. 5), thereby to transmit the rotation of the transmission shaft 48 to the rolling core 8. During this setting operation of the label rolling cassette 1 in the printer 3, the rotary bail 12 is held at the erected state indicated at double-dotted lines in FIG. 2.

A predetermined number of labels 6 are idly fed from a source (not shown) to the printer 3 until the leading end of the composite label web 4 is clamped by the actions of the clamping springs 10 of the rolling core 8. After that, printing is performed. During printing, the rolling core 8 is rotated to roll up the composite label web 4 in synchronism with the platen roll 57 for feeding the composite label web 4. As the rolling diameter of the rolling core 8 increases, the abutting portion 11 of the core slips relative to the slip rubber element 50 of the transmission shaft 48, effecting the rolling operation without trouble.

After a predetermined number of labels have been printed, a few more are idly fed, and the composite label web 4 is then cut by the cutter 59.

Next, the cassette 1 is removed from the printer 3 after the knobs 21 are pushed forward to disengage the hooks 20 from the hook holes 47.

The cassette 1 is next set in the label applier 2. The cut off, now leading end of the composite label web 4 is extracted, pulled forward to, and turned rearward around the front of the turning pin 16 at the front end of the cassette 1 and is then guided to extend along the guide groove 15 of the bottom guide plate 14 and then upward between the backing paper holding plates 18. Then, the rotary bail 12 is rotated counterclockwise to its solid line position in FIG. 2 so that the label holding portion 13 thereof abuts the composite label web 4. This guides the web to move straight forward to the pin 16, making the rearward turn around the pin 16 a sharp turn for facilitating label separation.

Figure 6:
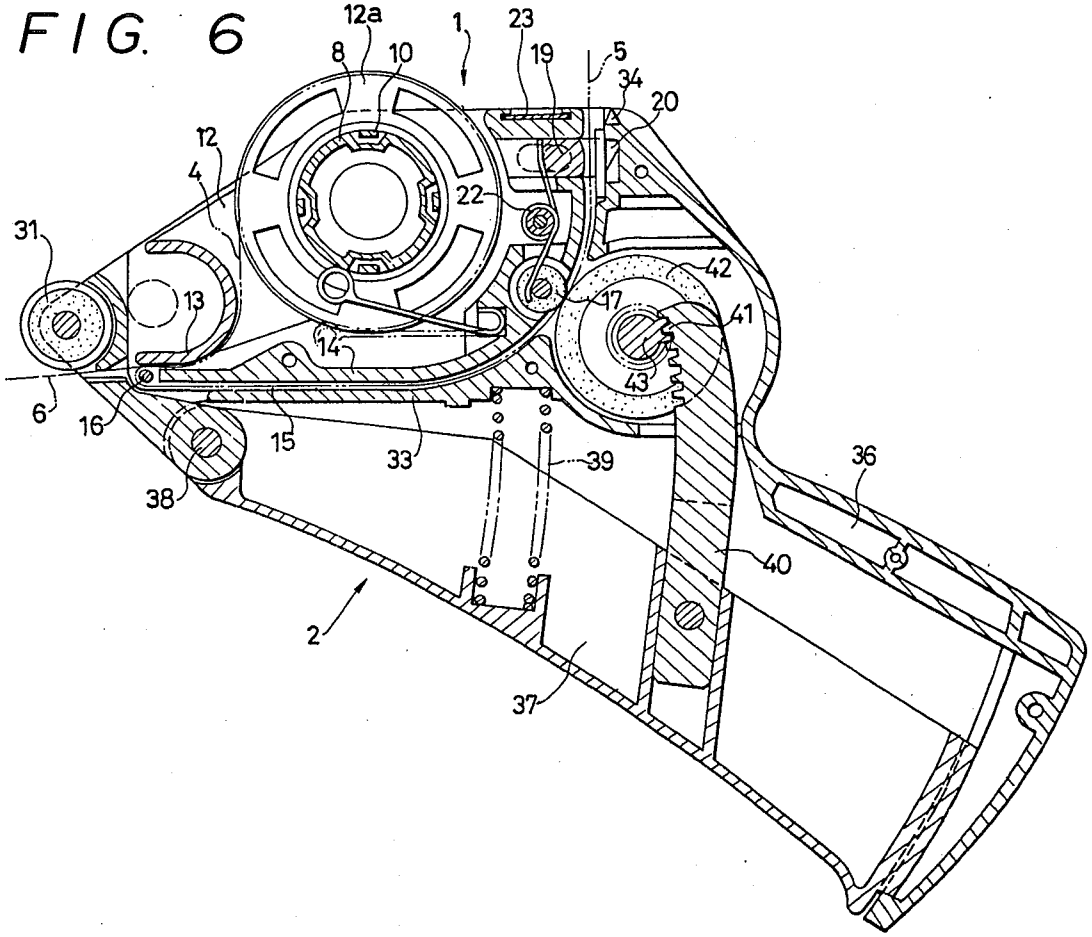
FIG. 6 is a section showing the label rolling cassette attached to the label applier.

Next, the attachment portion 26 of the cassette 1 is attached to the receptacle 29 of the applier 2, while the engaging lands 27 at the front end of that cassette 1 engage with the recesses 30 of the receptacle 29, until the hooks 20 come into engagement with the hook holes 35 (as shown in FIG. 6). By this setting step, a backing paper passage at the guide groove 15 is formed between the guide plate 14 of the cassette 1 and the guide plate 33 of the label applier 2, and the sub-roller 17 is moved to abut against the feed roller 42 to clamp the backing paper web 5 between them.

If the hand lever 37 is squeezed at this stage, the actuating lever 40 is moved upward so that its rack 41 rotates the pinion 43. However, the feed roller 42 cannot be rotated due to the one-way clutch mechanism. If the hand lever 37 is now released, the actuating lever 40 is moved down together with the hand lever 37 by the return spring 39 so that the feed roller 42 is rotated a predetermined angle in the clockwise direction together with the pinion 43. The backing paper web 5 is fed upward in accordance with the rotation of the feed roller 42 because it is clamped between the feed roller 42 and the sub-roller 17.

Only the backing paper web 5 is turned back around the pin 16 at an acute angle while the composite label web 4 at the turning pin 16 is held at a horizontal orientation by the label holding portion 13. As a result, the labels 6 are advanced to the left in FIG. 6, while being delaminated from their backing paper web 5, until the labels are fed to a position below their applying roller 31 through the label exit 32.

The labels 6 are applied to articles by the label applying roller 31 when the underside (i.e. the adhesive side) of the label 6 then below the applying roller 31 is applied to and rubbed against an article, similarly to what is done with the usual hand labeler.

The feed means for feeding the backing paper web 5 need not be limited to the combination of the feed roller 42 and the sub-roller 17. It can be a combination of perforations formed in a backing paper web and feed pins on the feed roller engaging with the perforations.

Figure 7:
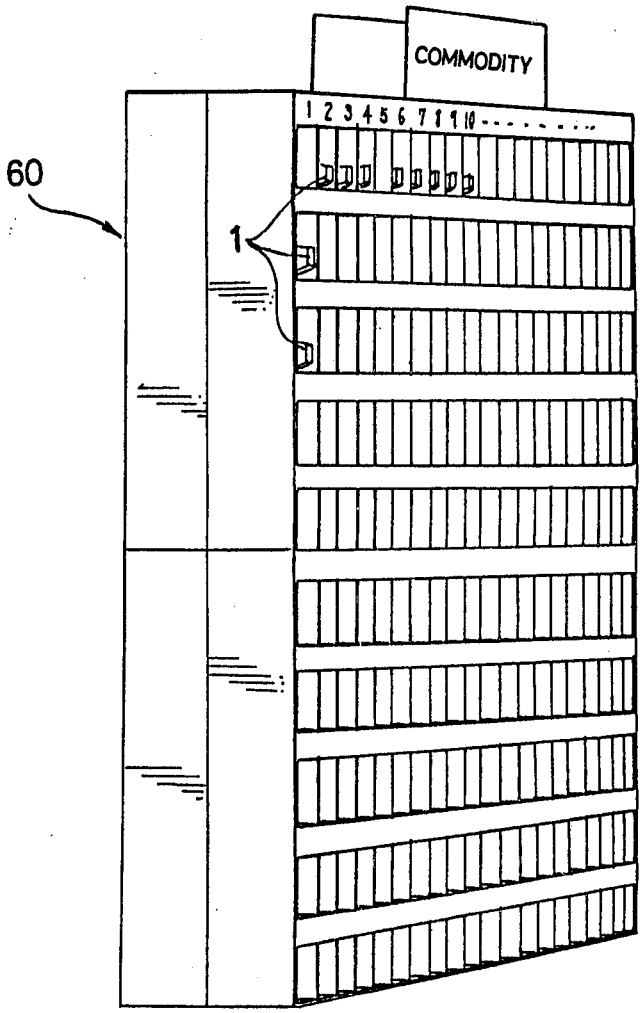
FIGS. 7 and 8 are perspective views showing a storage shelf and a box of the label rolling cassette, respectively.
Figure 8:
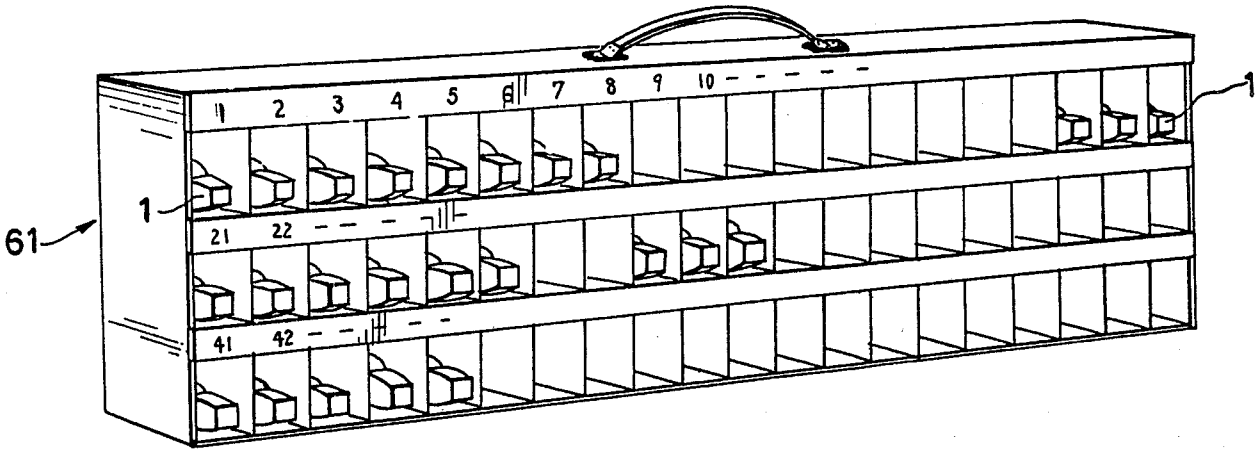
Figure 9:
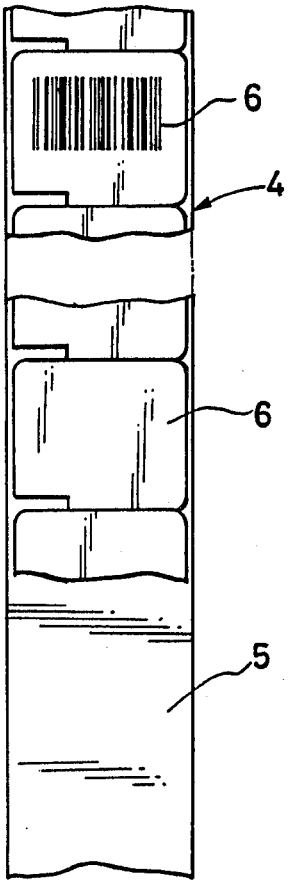
FIG. 9 is a perspective view of a composite label web.

A preferred embodiment of the label applying apparatus is now described. The apparatus can be used so that the composite label web 4 is printed each required time by means of the printer 3 and is then rolled up upon the cassette 1 and such that the cassettte 1 is then attached to the label applier 2 so that the labels 6 may be applied to goods. As an alternative, cassettes 1 may be specially prepared in advance for the respective goods and may be stored either in a fixed type storage shelf 60, as shown in FIG. 7, or in a portable type storage box 61, as shown in FIG. 8. Moreover, the stored cassettes 1 may be prepared to have a predetermined number of printed labels rolled up on them in the form of the composite label web, and a selected label roll may be extracted and set in the label applier 2 for each use.

The applications of labels to goods in a supermarket are done in a back room or at a sales counter. In the latter case, the means for carrying the desired cassettes 1 to the sales counter is conveniently exemplified either by the storage box 61 of FIG. 8 or by a belt (not shown) which is formed with a number of cassette receptacles similar to a gun cartridge belt.

As described above, the label applying apparatus according to the present invention comprises the label rolling cassette, which rolls up the composite label web that was printed by the printer, and the label applier to which that label rolling cassette is removably attached and which is manually operated to advance the label strip to delaminate the labels from their backing paper web and to apply the labels to articles. Therefore, the present invention can enjoy the following advantages:

1. Since the printing operation may be performed with a desk type printer, the imprints are more accurate and clearer than with printing by a hand labeler. Especially during printing bar codes, the check digits can also be automatically calculated and printed.

2. Since the printing head can be dispensed with, the label applier can save its size and weight reduced. As a result, the operation of the label applier can be improved to speed up the label applications and to reduce the fatigue of the operator.

3. The loading of the label applier with a label rolling cassette can be easily performed by a single action, trouble-free, so that the composite label web is guided in the label applier.

4. The label applying speed is higher than with the manually applying method while being freed of the disadvantageous blurring of the printed surfaces of the labels.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A portable label applying apparatus, comprising:

a rolled label strip cassette for holding a composite label web, which web comprises a series of labels temporarily adhered to a web of backing paper; the cassette comprising a cassette frame; label rolling means on the frame for having the composite label web rolled up theron; label delaminating means on the frame and spaced from the label rolling means for delaminating individual labels from the backing paper web; the frame having sides; guide means along one of the sides of the frame for guiding the backing paper web as it is fed away from the delaminating means; and a label applier to which the cassette is removably attached; the one side of the cassette frame being disposed toward the label applier; feed means in the label applier for engaging the backing paper web at the guide means and for feeding the backing paper web in a direction which delaminates the labels from the backing paper web at the delaminating means.

2. The label applying apparatus of claim 1, wherein the cassette has a front at which the labels are to be delivered for applying to another article and a rear away from the front; the delaminating means being located toward the front of the cassette and the delaminating means being shaped to return the backing paper web toward the rear of the cassette.

3. The label applying apparatus of claim 2, wherein the cassette has a bottom which is the side thereof disposed toward the label applier and the delaminating means is disposed at the bottom side of the cassette for moving the backing paper web past the bottom of the cassette at the label applier.

4. The label applying apparatus of either of claims 2 or 3, wherein the delaminating means comprising a turning pin disposed at the front of the cassette for the backing paper web to be wrapped around the pin and to thereafter be moved toward the rear of the cassette for delaminating individual labels from the web at the turning pin.

5. The label applying apparatus of claim 4, further comprising label applying means located near the delaminating means for receiving and then applying the delaminated labels to other articles.

6. The label applying apparatus of claim 3, wherein the label rolling means comprises a rolling core supported to the frame; clamping means on the rolling core for clamping the leading end of a composite label web for initiating rolling of the web onto the rolling core, whereby the web may thereafter be wound onto the rolling core.

7. The label applying apparatus of claim 6, further comprising a bail supported to the frame of the cassette and being movable between a first position away from the delaminating means and a second position closer to the delaminating means; a label strip holding portion on the bail for engaging the label strip in the second position of the bail for shifting the label strip to make a sharp turn around the delaminating means for aiding in delamination of labels from the backing paper web.

8. The label applying apparatus of claim 1, wherein the guide means comprises a guide plate extending beneath the bottom of the cassette between the cassette and the label applier for guiding the delaminated backing paper web; and an outlet for the backing paper web from between the cassette guide plate and the label applier.

9. The label applying apparatus of claim 8, wherein the label strip feed means projects from the label applier toward the guide plate to contact the backing paper web at the guide plate.

10. The label applying apparatus of claim 8, wherein the guide plate is convexly curved between the delaminating means and the outlet for the backing paper web from between the cassette guide plate and the label applier.

11. The label applying apparatus of claim 8, wherein the label applier has a recess into which the cassette is positioned and the recess is shaped to generally conform to the shape of the guide plate of the cassette.

12. The label applying apparatus of claim 11, wherein the label strip feed means projects from the label applier into the recess to contact the backing paper web at the guide plate.

13. The label applying apparatus of claim 12, wherein the label strip means feed means comprises a feed roller rotatably attached to the label applier and projecting into the recess sufficiently to contact the backing paper web at the guide plate.

14. The label applying apparatus of claim 13, further comprising an actuating lever on the label applier and connected with the feed roller for rotating the feed roller in contact with the backing paper web to feed the backing paper web.

15. The label applying apparatus of claim 8, wherein the guide plate includes a backing paper guide groove extending along the guide plate.

16. The label applying apparatus of claim 1, further comprising label applying means located near the delaminating means for receiving and then applying the delaminated labels to other articles.

17. The label applying apparatus of claim 1, wherein the label rolling means comprises a rolling core supported to the frame; clamping means on the rolling core for clamping the leading end of a composite label web for initiating rolling of the web onto the rolling core, whereby the web may thereafter be wound onto the rolling core.

18. The label applying apparatus of claim 17, wherein the clamping means comprises a recess formed on the outer circumference of the core and comprises a clamping spring for clamping the leading end of the composite label web at the recess.

19. The label applying apparatus of claim 1, wherein the cassette is removably attachable to a printer for printing the labels and for delivering the printed labels to the label rolling means.

20. The label applying apparatus of claim 19, further comprising a label printer for being separably attached to the cassette for imprinting labels on a label strip, and including means for printing the labels and means for feeding the label strip onto the label rolling means.

21. The label applying apparatus of claim 20, wherein the printer feeding means includes a drive for feeding the label strip through the printer and a roller connected with the drive and also with the label rolling means for rotating the label rolling means to wind on the label strip.

22. The label applying apparatus of claim 21, further comprising a slip permitting connection between the label rolling means and the roller in the printer for permitting slip in the rotation of the label rolling means as the size the label roll increases.

23. A portable label applying apparatus, comprising:

a rolled label strip cassette for holding a composite label web, which web comprises a series of labels temporarily adhered to a web of backing paper; the cassette comprising a cassette frame; label rolling means on the frame for having the composite label web rolled up thereon; label delaminating means on the frame and spaced from the label rolling means for delaminating individual labels from the backing paper web; and guide means on the frame for guiding the backing paper web away from the delaminating means;

a label applier to which the cassette is removably attached; feed means in the label applier for engaging and feeding the backing paper web in a direction which delaminates the labels from the backing paper web at the delaminating means; and a bail supported to the frame of the cassette and being movable between a first position away from the delaminating means and a second position closer to the delaminating means; a label strip holding portion on the bail for engaging the label strip in the second position of the bail for shifting the label strip to make a sharp turn around the delaminating means for aiding in delamination of labels from the backing paper web.

24. The label applying apparatus of claim 23, wherein the label strip holding portion is convexly curvedly shaped for engaging the web between the label holding means and the delaminating means; with the bail in its second position, for shifting the label strip to make a sharper turn.

25. The label applying apparatus of either of claims 23 or 24, wherein the delaminating means comprising a turning pin disposed at the front of the cassette for the backing paper web to be wrapped around the pin and to thereafter be moved toward the rear of the cassette for delaminating individual labels from the web at the turning pin.

26. The label applying apparatus of claim 24, wherein the bail is hingedly attached to the cassette frame for pivoting between the first and second positions thereof.

27. The label applying apparatus of claim 26, wherein the hinged attachment for the bail is such that the bail extends toward the delaminating means from the hinged attachment thereof.

28. The label applying apparatus of claim 24, wherein the holding portion of the bail is semi-circularly curved.

29. The label applying apparatus of claim 28, wherein the bail has sideways looseness preventing plates for the label strip and placed so that with the bail in the second position thereof, the looseness preventing plates prevent the label strip from shifting sideways between the label rolling means and the delaminating means.

30. The label applying apparatus of claim 23, wherein the bail has sideways looseness preventing plates for the label strip and placed so that with the bail in the second position thereof, the looseness preventing plates prevent the label strip from shifting sideways between the label rolling means and the delaminating means.

31. The label applying apparatus of claim 23, wherein the ball is hingedly attached to the cassette frame for pivoting between the first and second positions thereof.

32. The label applying apparatus of claim 31, wherein the hinged attachment for the bail is such that the bail extends toward the delaminating means from the hinged attachment thereof.

33. The label applying apparatus of claim 23, wherein the guide means comprises a guide plate extending beneath the bottom of the cassette between the cassette and the label applier for guiding the delaminated backing paper web.

34. The label applying apparatus of either claims 15 or 33, wherein the guide plate is convexly curved between the delaminating means and an outlet for the backing paper web from between the cassette guide plate and the label applier.

35. The label applying apparatus of claim 34, wherein the label strip feed means comprises a feed roller rotatably attached to the label applier and an actuating lever on the label applier and connected with the feed roller for rotating the feed roller to engage and feed the backing paper web.

36. The label applying apparatus of claim 35, wherein the label applier has a recess into which the cassette is positioned and the recess is shaped to generally conform to the shape of the guide plate of the cassette.

37. The label applying apparatus of claim 35, further comprising a one-way clutch connected with the feed roller for permitting rotation of the feed roller only in the direction which moves the backing paper web to feed labels to the delaminating means.

38. The label applying apparatus of claim 38, further comprising a sub-roller rotatably fitted to the cassette and placed for cooperatively engaging the feed roller and the backing paper web between the sub-roller and the feed roller.

39. A portable label applying apparatus, comprising:

a rolled label strip cassette for holding a composite label web, which web comprises a series of labels temporarily adhered to a web of backing paper; the cassette comprising a cassette frame; label rolling means on the frame for having the composite label web rolled up thereon; label delaminating means on the frame and spaced from the label rolling means for delaminating individual labels from the backing paper web; and guide means on the frame for guiding the backing paper web away from the delaminating means; and a label applier to which the casssette is removably attached; feed means in the label applier for engaging and feeding the backing paper web in a direction which delaminates the labels from the backing paper web at the delaminating means;

the label strip feed means comprises a feed roller rotatably attached to the label applier and an actuating lever on the label applier and connected with the feed roller for rotating the feed roller to engage and feed the backing paper web.

40. The label applying apparatus of claim 39, further comprising a one-way clutch connected with the feed roller for permitting rotation of the feed roller only in the direction which moves the backing paper web to feed labels to the delaminating means.

41. The label applying apparatus of claim 40, further comprising a rack on the actuating lever and a pinion connected with the feed roller and the actuating lever being connected with the feed roller through the rack engaging the pinion, such that motion of the actuating lever is translated into rotation of the feed roller.

42. The label applying apparatus of claim 34, further comprising a sub-roller rotatably fitted to the cassette and placed for cooperatively engaging the feed roller and the backing paper web between the sub-roller and the feed roller.

43. A portable label applying apparatus, comprising:

a rolled label strip cassette for holding a composite label web, which web comprises a series of labels temporarily adhered to a web of backing paper; the cassette comprising a cassette frame, label rolling means comprising a rolling core supported to the frame for having the composite label web rolled up thereon; label delaminating means on the frame and spaced from the label rolling means for delaminating individual labels from the backing paper web;

and guide means on the frame for guiding the backing paper web away from the delaminating means after delamination;

a bail hingedly supported to the cassette frame for being movable between a first position away from the delaminating means and a second position closer to the delaminating means; a label strip holding portion on the bail for engaging the label strip in the second position of the bail for shifting the label strip to make a sharp turn around the delaminating means for aiding in delamination of labels from the backing paper web;

a label applier to which the cassette is removably attached; feed means in the label applier for engaging and feeding the backing paper web in a direction which delaminates the label from the backing paper web at the delaminating means; the feed means in the label applier comprises a feed roller rotatably attached to the label applier and an actuating lever on the label applier and connected with the feed roller for rotating the feed roller to engage and feed the backing paper web;

the delaminating means being disposed at the bottom side of the cassette near the label applier for moving the backing paper web past the bottom of the cassette at the label applier.

* * * * *